US006929149B2

(12) United States Patent
Selfridge et al.

(10) Patent No.: US 6,929,149 B2
(45) Date of Patent: Aug. 16, 2005

(54) FROZEN PRODUCT VENDING MACHINE

(75) Inventors: Glenn D. Selfridge, Martinsburg, WV (US); Clayton Herzog, Waynesboro, PA (US)

(73) Assignee: Royal Vendors, Inc., Kearneysville, WV (US)

( * ) Notice: Subject to any disclaimer, the term of this patent is extended or adjusted under 35 U.S.C. 154(b) by 0 days.

(21) Appl. No.: 10/175,061

(22) Filed: Jun. 20, 2002

(65) Prior Publication Data

US 2003/0234259 A1 Dec. 25, 2003

(51) Int. Cl.[7] ..... G07F 11/72
(52) U.S. Cl. ..... 221/150 R; 221/211; 221/278
(58) Field of Search ..... 221/150 R, 123, 221/141, 133, 211, 278; 312/401, 236; 62/276

(56) References Cited

U.S. PATENT DOCUMENTS

| | | | | | |
|---|---|---|---|---|---|
| 2,486,724 | A | * | 11/1949 | Weber et al. | 62/256 |
| 2,524,673 | A | | 10/1950 | Martin | |
| 2,669,850 | A | * | 2/1954 | Bishop | 62/256 |
| 2,693,089 | A | * | 11/1954 | Teeter | 62/253 |
| 2,705,875 | A | * | 4/1955 | Pichler | 62/251 |
| 2,923,135 | A | * | 2/1960 | Preotle | 62/157 |
| 2,967,404 | A | * | 1/1961 | Detwiler | 62/256 |
| 3,421,338 | A | * | 1/1969 | Gidseg | 62/155 |
| 3,756,038 | A | * | 9/1973 | MacMaster et al. | 62/256 |
| 3,948,407 | A | * | 4/1976 | Puterbaugh | 220/4.01 |
| 3,986,638 | A | | 10/1976 | DeHart | |
| 4,304,098 | A | * | 12/1981 | Rydahl | 62/82 |
| 4,314,457 | A | * | 2/1982 | Ibrahim | 62/256 |
| 4,375,126 | A | | 3/1983 | Düll et al. | |
| 4,399,662 | A | * | 8/1983 | Ibrahim | 62/82 |
| 4,473,922 | A | | 10/1984 | Weihe | |
| 4,639,875 | A | | 1/1987 | Abraham et al. | |
| 4,677,278 | A | | 6/1987 | Knoll | |
| 4,920,764 | A | * | 5/1990 | Martin | 62/259.1 |
| 4,932,548 | A | * | 6/1990 | Bensinger | 220/552 |
| 4,977,754 | A | * | 12/1990 | Upton et al. | 62/248 |

(Continued)

FOREIGN PATENT DOCUMENTS

| | | |
|---|---|---|
| AU | 685400 | 1/1998 |
| CA | 2169086 | 1/1999 |
| DE | 2455673 | 5/1976 |
| EP | 0755032 | 1/1997 |
| JP | 2001148063 | 5/2001 |

*Primary Examiner*—Donald P. Walsh
*Assistant Examiner*—Matthew J. Kohner
(74) *Attorney, Agent, or Firm*—Jacobson Holman PLLC

(57) ABSTRACT

A frozen product, upright-style vending machine having a pick and place mechanism moveable in three dimensions (X, Y, Z) with a fourth, rotational, degree of freedom (W) effected using the Z axis drive. The mechanism moves along tracks in the X-Y directions and is permitted full range of motion by an extension hose. Frozen products are arranged in a container within the vending machine freezer, the container acting as a virtual cold-wall freezer trapping cold air. The pick and place mechanism positions a vacuum pick-up head over the appropriate product along the X-Y tracks in response to a customer selection. The vacuum pick-up head is attached to a vacuum hose which is wound on a hose reel. The vacuum hose is unwound to lower the vacuum pick-up head along the Z axis to the selected product and, when suction has been established against a selected product in the virtual cold-wall freezer, the vacuum hose is rewound. By over-driving the Z-axis drive motor, the pick-up head is rotated to a horizontal position by hose tension, and the product is dispensed through a delivery door positioned relatively high on the vending machine such that the frozen products are not dropped a significant distance and broken during delivery.

25 Claims, 14 Drawing Sheets

U.S. PATENT DOCUMENTS 5,027,698 A 7/1991 Chirnomas
5,097,986 A 3/1992 Domberg et al.
5,121,854 A * 6/1992 Trouteaud et al. ..... 221/15
5,236,103 A * 8/1993 Ficken et al. ..... 221/124
5,240,139 A 8/1993 Chirnomas
5,305,615 A 4/1994 McFadden et al.
5,322,187 A 6/1994 Zizola
5,475,988 A * 12/1995 McGovern ..... 62/256
5,816,635 A 10/1998 Jansson
5,941,622 A * 8/1999 Davidson et al. ..... 312/400
5,971,205 A 10/1999 Michaels et al.
6,170,285 B1 * 1/2001 Huffman et al. ..... 62/448
6,186,358 B1 2/2001 Peteraf
6,253,955 B1 7/2001 Bower
6,308,522 B1 10/2001 Jones et al.
6,378,324 B1 * 4/2002 Percy et al. ..... 62/448
6,431,395 B1 * 8/2002 San Martin et al. ..... 221/2
6,481,226 B2 * 11/2002 Jones et al. ..... 62/190
6,547,096 B1 * 4/2003 Chirnomas ..... 221/123
2003/0230095 A1 * 12/2003 Kahler ..... 62/155

* cited by examiner

FROZEN PRODUCT VENDING MACHINE

BACKGROUND OF THE INVENTION

1. Field of the Invention

The present invention is related to the field of vending machines and, more particularly, to a frozen product vending machine with improved storage and delivery capability.

2. Description of the Related Art

Frozen food products stored for future consumption are sensitive to their temperature history. Ice cream in particular will degrade in texture and flavor when exposed to temperature variations which exceed a specified storage range over time.

Some frozen food vendors on the market use an upright style freezer, i.e., one having a vertically hinged door. Such freezer styles have advantages in that most of the interior space can be used for product storage, and the forced convection systems used make automatic defrost possible. There are significant disadvantages with the upright style, however. Because cold air is very heavy as compared to warm air, much of the cold air within the refrigerated space is replaced by warm air when the door is opened. This exposes stored products to high temperatures which degrades the product quality. In addition, each time an automatic defrost cycle is initiated, the product is exposed to higher than desired temperatures and this cyclic variation also results in product quality degradation.

Upright freezer configurations normally deliver product through a port located at the lower section of the freezer compartment. As with the opening of the freezer door, opening of the port to deliver the product to the customer allows cold air to escape from the freezer and be replaced with warm air. As a result, a substantial heat gain is produced, imparting thermal shock to the product. Condensation and subsequent freezing also results in the build-up of ice on the delivery port mechanism and throughout the freezer.

As an additional problem, because the delivery port is located a substantial vertical distance from where the frozen products are actually stored, impact damage occurs when the product is dropped. This is very undesirable, particularly since many frozen confections include very thin shells of chocolate, cone and the like which are easily broken upon impact with a hard surface.

One solution for the problem of air temperature transfer during door opening is a chest style freezer having a horizontally hinged door. With this design, the chest acts as a "pool", holding the heavier cold air in place when the access door is opened. Drawbacks, on the other hand, include the fact that a chest-style freezer is not easily defrosted on an automatic basis, allowing ice to build over time and requiring manual removal. Furthermore, in a vending application, a chest does not easily accommodate a package delivery mechanism. Known configurations of chest freezer vending machines, such as that shown in U.S. Pat. No. 6,253,955 to Bower, often have external vending mechanisms which seriously reduce the available capacity of the vending machine for a fixed exterior size.

Capacity has been a problem with many different package delivery mechanisms. In a conventional "pick and place" mechanism, the dimensions of an axis must at least equal the total desired travel. Any extensions required, such as to reach into a space not permitted by the dimensions of the axis drive and bearing dimensions, must be added to the basic axis dimension. For a device that must reach into a bin, which may have small length and width dimensions as compared to the depth dimension, the overall length of the axis mechanism can be quite large. In that most vending machines have exterior size limitations, the size constraints for a machine using a pick and place mechanism to select a product from a storage bin for ultimate delivery to a customer make a practical design very difficult.

In addition, according to conventional product delivery mechanisms, the product is delivered to the customer by moving along the X and Y axes to a position over a chute leading to a delivery port located toward the lower section of the machine. The product is then dropped into the chute and delivered to the customer through the port. Delivery in this manner requires a port depth large enough to accommodate the width dimension of the product, thus consuming a large portion of the interior space of the vending machine. As an alternate, the product may be forced to do a flip as it falls toward the delivery location; this action tends to break a fragile product.

A need exists, therefore, for a means of operating along the vertical or "Z" dimension in a compact manner. One known design for such a device, disclosed in U.S. Pat. No. 5,240,139 to Chirnomas, uses a self-storing extension hose with a cable lifting drive in an attempt to minimize the length of the vertical axis. The problem with this configuration lies with the minimum overall length of the hose in its retracted position. A commercial design using such a retrieval mechanism wastes an unacceptably large portion of the available vending cabinet space.

In summary, a need exists for a frozen product vending machine which overcomes problems in the art including damage to the frozen products from temperature variation, damage to the frozen products from being dropped during dispensing to a customer, and inefficient use of vending machine storage space.

SUMMARY OF THE INVENTION

In view of the foregoing, one object of the present invention is to overcome the difficulties of storing sufficient product volume in a frozen product vending machine.

A second object of the invention is an ice cream vending machine having a virtual cold wall freezer which prevents damage to the frozen products arising from temperature variation.

Another object of the invention is a vending machine which dispenses products through a delivery port located relatively high on the machine, reducing cold air loss from the vending machine and protecting the product from fall damage.

Yet another object of the invention is a deeply extended vertical pick and place axis requiring a minimum amount of space and having a drive for the vertical axis within the vending storage device.

A further object of the invention is a vending machine delivery mechanism having a tip-up functionality which, when combined with a port located in the upper portion of the freezer, makes the delivery very convenient for the customer.

A still further object of the invention is a tip-up functionality for a vending machine delivery mechanism which is accomplished using the same drive elements used to move the product in the vertical direction.

Yet another object of the invention is a vending product retrieval system including a hose reel and vacuum hose which, when fully retracted, takes up far less space than conventional telescoping cable lifting drives, enabling greater product volume to be stored in the vending storage bins.

A further object of the invention is a delivery port opening structure that has vertical and horizontal positions for maximizing usable frozen product storage space.

Another object of the invention is a vending machine for frozen products that includes a virtual cold wall freezer which protects the frozen products by trapping cold air and preventing exposure of the products to temperature variation when the vending machine is stocked or otherwise accessed.

A still further object of the invention is a "false" chest freezer which prevents thermal damage while allowing frost-free operation.

In accordance with these and other objects, the present invention is directed to a vending machine for frozen products comprising a freezer unit equipped with refrigeration and condensation removal systems such as those known in the art. Within this unit are incorporated inventive aspects including a virtual cold-wall freezer; a highly retractable Z-axis member drive and storage pick and place mechanism; a "tip-up" delivery mechanism for delivery of a product without a significant drop through a delivery port located relatively high on the vending machine; and a delivery port opening structure with a dual-position extension bar having a vertical plane storing position.

The virtual cold-wall freezer is a five-sided container, open at the top, which fits within the overall freezer compartment of the vending machine and protects frozen products placed therein by trapping cold air and preventing exposure to temperature variation when the vending machine is stocked or otherwise accessed.

The pick and place mechanism includes a vacuum pick-up head which moves along tracks in X & Y directions. Full range of motion is permitted by an extension hose. Frozen products are arranged in the five-sided container in a plurality of bins. The pick and place mechanism positions the vacuum pick-up head over the appropriate bin along the X-Y tracks in response to a customer selection. The vacuum pick-up head is attached to a vacuum hose which is wound on a hose reel. The vacuum hose is unwound to lower the vacuum pick-up head along the Z axis to the selected product and, when suction has been established, the vacuum hose is rewound to bring the pick-up head back to the starting Z-axis position. The head is rotated to a horizontal or "tip-up" position by hose tension and positioned adjacent the delivery port, where the deployed delivery port extension bar opens the port and the product is dispensed to the customer.

These together with other objects and advantages which will become subsequently apparent reside in the details of construction and operation as more fully hereinafter described and claimed, reference being had to the accompanying drawings forming a part hereof, wherein like numerals refer to like parts throughout.

DETAILED DESCRIPTION OF THE PREFERRED EMBODIMENTS

Figure 1:
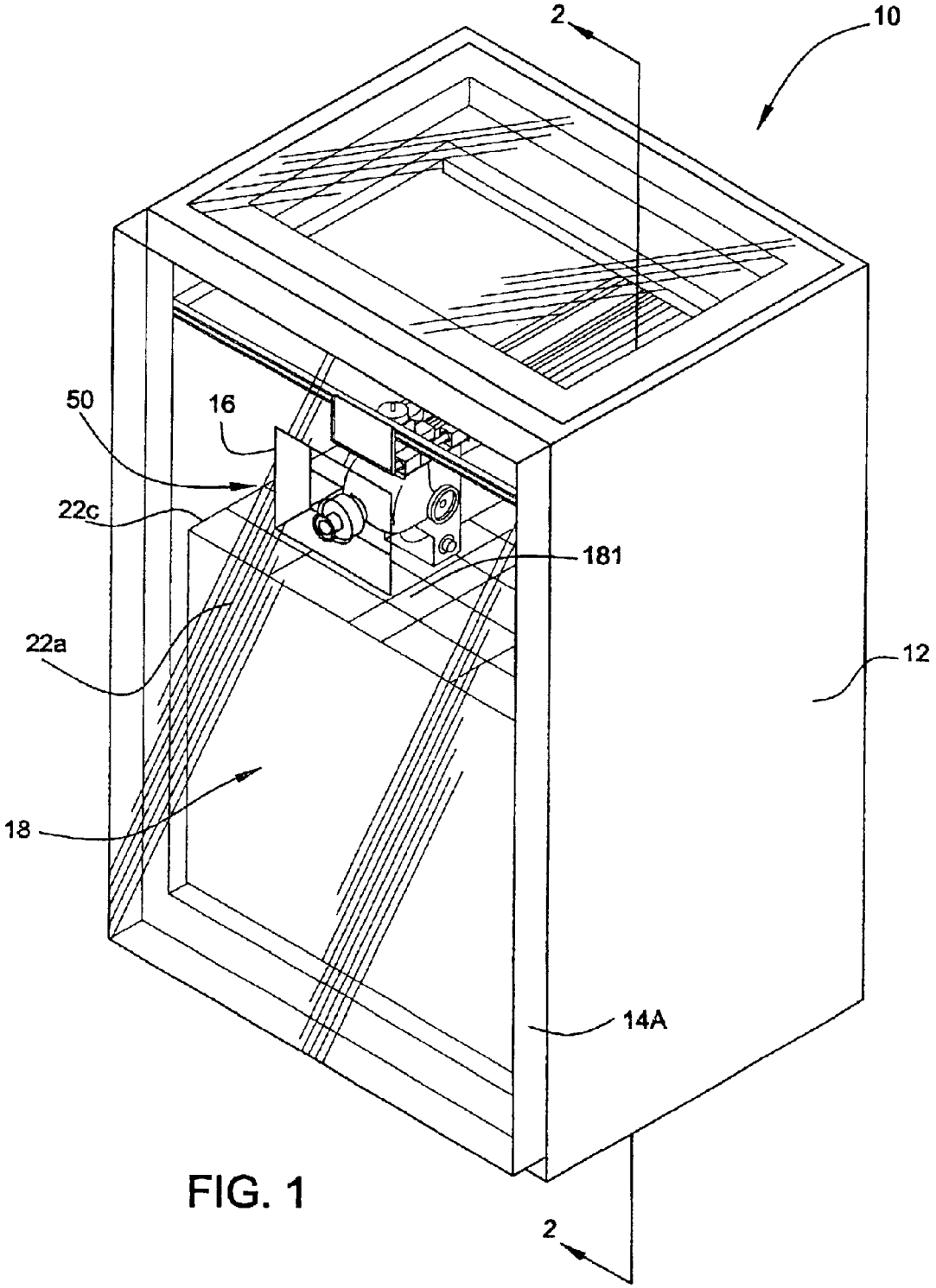
FIG. 1 is a perspective view of an upright-style vending machine for frozen products in accordance with the present invention, the inner door shown in a transparent state.
Figure 2:
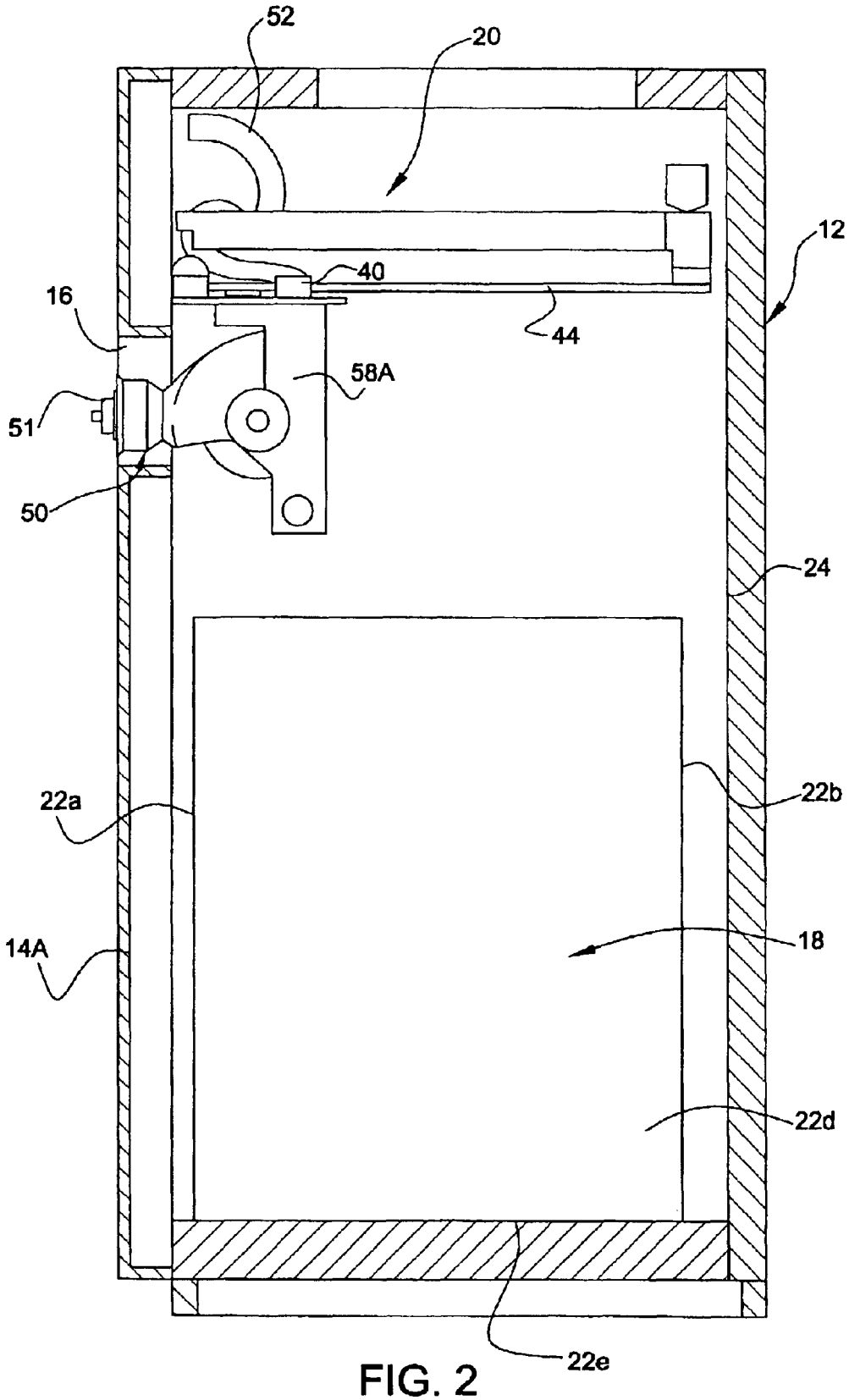
FIG. 2 is a cross-sectional view taken along the line 2—2 of the upright-style vending machine of FIG. 1.
Figure 3:
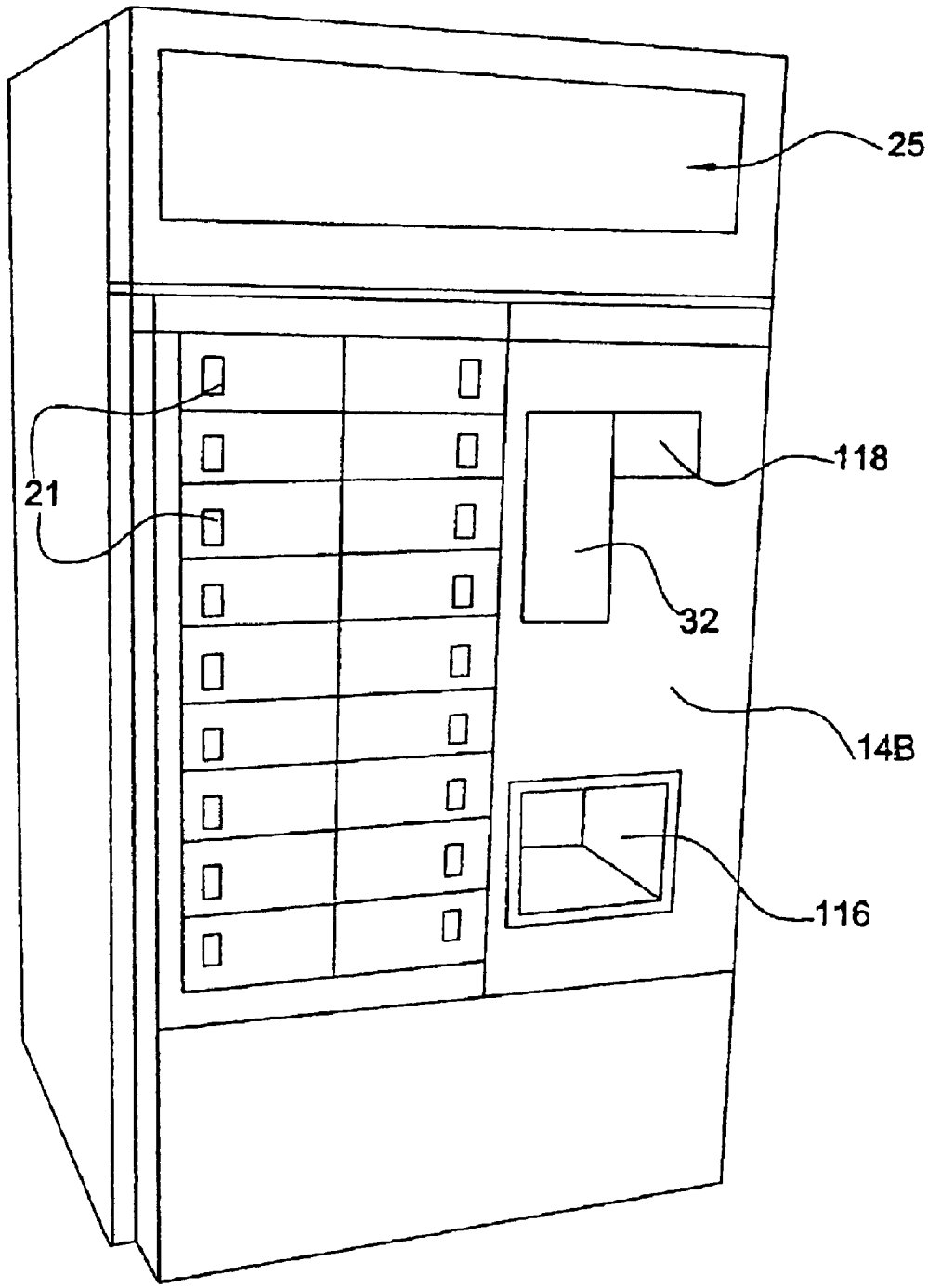
FIG. 3 is an front perspective view of an upright-style vending machine such as that of FIG. 1.
Figure 5:
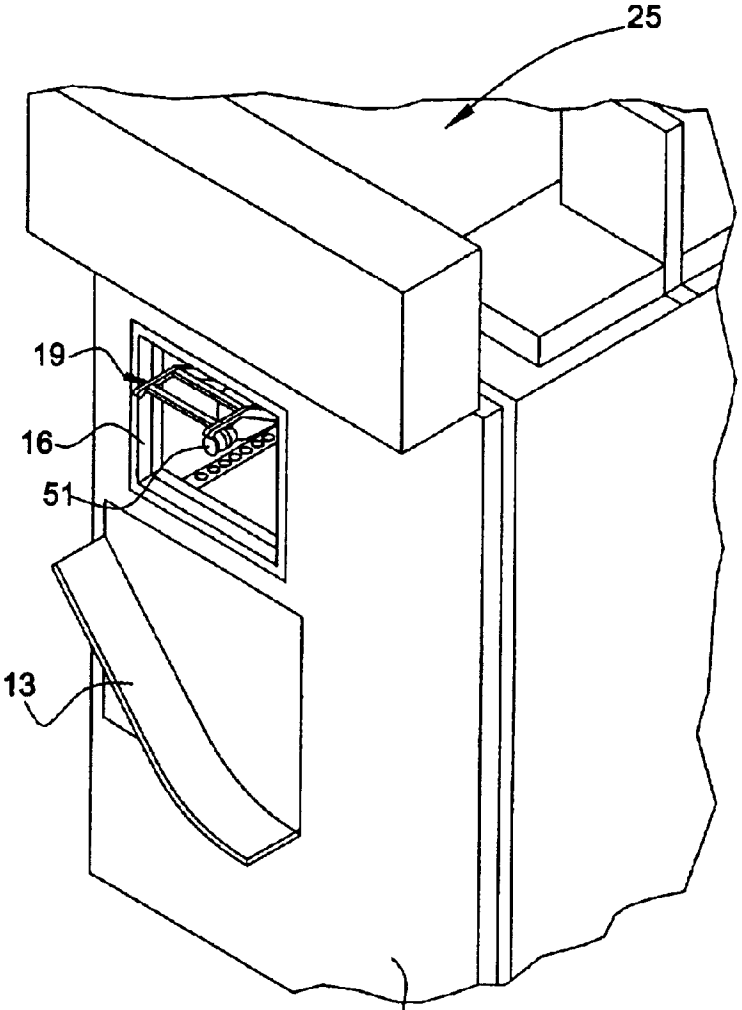
FIG. 5 is a perspective view of the vending machine of FIG. 1, without the outer door to display the chute.
Figure 4:
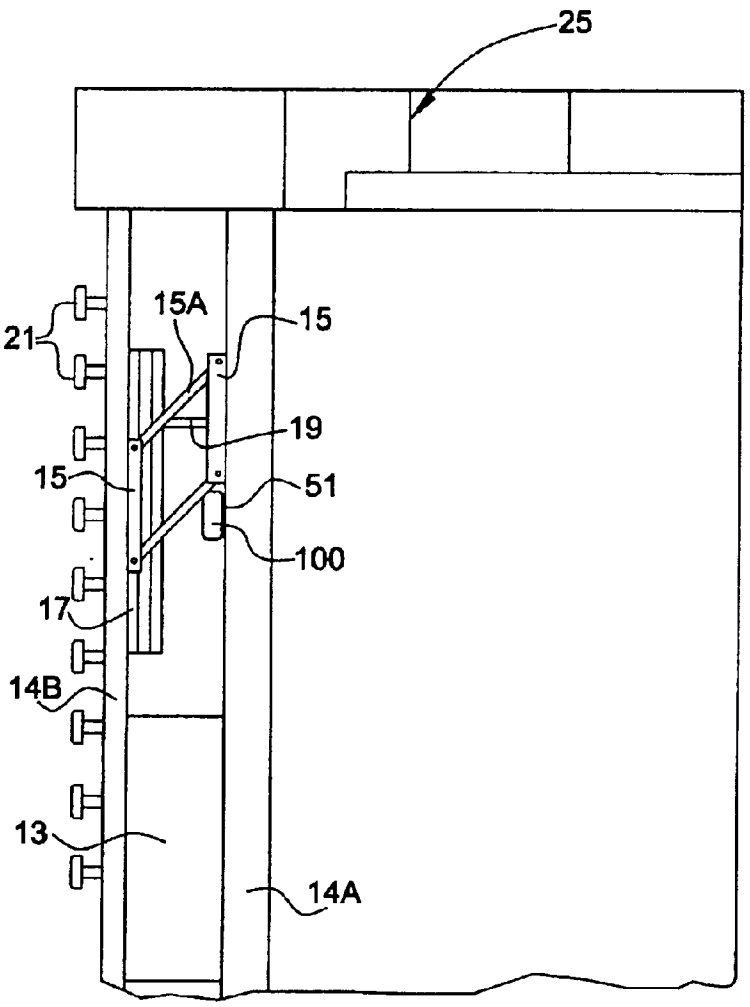
FIG. 4 is a side view of an upright-style vending machine such as that of FIG. 1 and including the outer door, chute and hatch mechanism.

In describing a preferred embodiment of the invention illustrated in the drawings, specific terminology will be resorted to for the sake of clarity. However, the invention is not intended to be limited to the specific terms so selected, and it is to be understood that each specific term includes all technical equivalents which operate in a similar manner to accomplish a similar purpose.

A vending machine for frozen products according to the present invention, generally designated by the reference numeral 10, is illustrated in FIGS. 1–7. The machine 10 includes an upright-style freezer unit 12 having an inner door 14A (shown in a transparent state in FIG. 1) and an outer door 14B, shown in FIGS. 3 and 4; both the inner door 14A and the outer door 14B open from the front. Mounted within and near the top portion of the freezer unit 12 is a product delivery mechanism, generally designated by the reference numeral 20.

Within the inner door 14A, which is approximately 2.5 inches in thickness, is a product delivery port 16 through which the product delivery mechanism 20 extends to release a frozen product 100 to a chute 13 for delivery to a customer. The chute is preferably attached to the outer door 14B.

The delivery port 16, which is preferably on a plane common with the suction head in the tipped-up delivery position of the product delivery mechanism 20, is opened and closed using a hatch 17. The hatch 17 is connected to the inner door by hinges 15 and hinge arms 15A. The hatch is opened by a delivery port opening structure, generally designated by the reference numeral 19, which is hingedly connected to the product delivery mechanism 20. The delivery port opening structure 19 according to the invention is provided with rollers 23 which contact the inner surface of the hatch; in FIG. 7, the hatch is shown in a transparent state to illustrate the rollers 23. In response to pressure from the delivery port opening structure 19, the hatch moves, on the hinge arms 15A, up and out, relative to the port 16. The product 100 is then thrust into the space 102 above the chute 13 and between the inner door 14A and the outer door 14B. For clarity, the outer door 14B is not shown in FIGS. 1, 2, 5, 6 and 7. For similar reasons, the hatch mechanism is not shown in FIGS. 1, 2 and 5.

The delivery port opening structure may be replaced with a conventional pusher-bar having a rigid extension in the horizontal direction. However, such a conventional pusher-bar restricts the range of motion of the pick and place mechanism, limiting product storage space as there must be sufficient room to accommodate the pusher-bar. Accordingly, it is preferable to include the inventive delivery port opening structure with vertical storage position according to the present invention for maximum use of vendible product space.

Situated within the freezer unit 12 is a virtual cold-wall freezer 18, generally designated by the reference numeral 18. The virtual cold-wall freezer 18 is a five-sided container having a front side 22*a*, a rear side 22*b*, a left side 22*c*, a right side 22*d*, and a bottom side 22*e*. The front side 22*a* is adjacent the doors 14A, 14B, with the left and right sides, 22*c*, 22*d*, respectively, so designated as viewed from the front side 22*a*. The top of the container is open, allowing unobstructed access by the product delivery mechanism to the bins 181 contained within the front, rear, left, right and bottom sides. The sides 22 of the container are made of thermally conductive material and are spaced away from the interior walls 24 and bottom of the freezer 12. The container may be embodied as a non-insulated sheet metal box. A preferred material is embossed aluminum, but powder-coated galvaneel, or any other thermally-conductive material, may also be used.

The present invention maintains the basic functionality of the upright freezer while gaining the beneficial thermal characteristics of a chest-type freezer in a frozen product vending machine. Each frozen product is stored in one of a plurality of vertical bins 181 defined in the vertical freezer 18. Frozen product is usually in the shape of a rectangular solid 100 with a thickness which is less than a length or a width dimension. As described herein, the frozen product is stored within the bin such that the width and length dimensions lie in a horizontal plane.

Cooling of the freezer is preferably provided by a forced air coil with a conventional automatic defrost cycle included. The air handler with air coil are preferably mounted above the product delivery mechanism in an upper unit, generally designated by the reference numeral 25. During normal cooling operation, chilled air from the forced air coil is circulated around all sides of the container 18, thereby providing cooling to the contents of the container.

During a defrost cycle, the warm air generated by the defrost cycle is contained at the top of the freezer 12. With no air circulation, the temperature rise caused by the defrost does not substantially affect the contents of the container 18. This permits a non-damaging automatic defrost to be completed, which is not possible in a conventional chest-type freezer.

When the freezer doors 14A, 14B are opened for loading or service, the cold air is trapped within the virtual cold-wall freezer 18 and does not spill out. This maintains a steady temperature condition for the frozen product during such events and simulates the environment provided by a chest freezer.

The virtual cold-wall freezer container 18 may further include a tilt mechanism (not shown) for easier access during loading and clean up, as well as means for completely detaching the container for dumping its contents in the event of product meltdown. The tilt mechanism may be embodied as chassis slides or any other structure suitable for facilitating access to the container 18. The container may also be secured to the bottom of the vending machine to maintain the exact position of the container within the machine during use and shipping.

Because the footprint of the "cabinet" of the vending machine 10 also defines the upright freezer 12 with the container therein, large vending capacity gains are realized as compared with the conventional design in which a chest freezer is placed inside of a non-refrigerated vending cabinet in the same size envelope.

Figure 8:
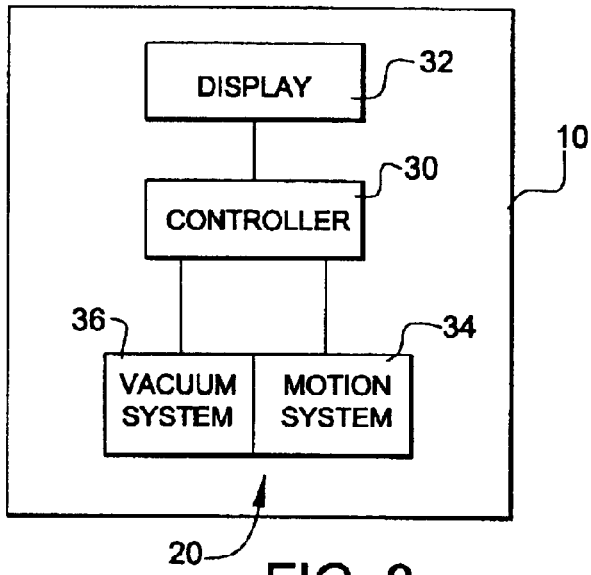
FIG. 8 is a block diagram of the components of a product delivery mechanism for a vending machine in accordance with the present invention.

As representatively depicted in FIG. 8, the frozen product vending machine 10 is controlled by a controller 30. The user interacts with the controller 30 through a display 32, which includes indicator lights and selection switches 21, shown in FIGS. 3 and 4. The machine also includes conventional means for inputting currency 118 so that a customer may pay for a desired product. Once the controller 30 registers a currency credit and the customer enters a product selection, the controller activates the delivery mechanism 20 to effect product delivery through access door 116. The delivery mechanism 20 integrates a four-axis automated motion system 34 with a vacuum system 36 to provide "pick and place" functionality. The vacuum system provides the "picking" function while the motion system fulfills the "placing" function.

Figure 10:
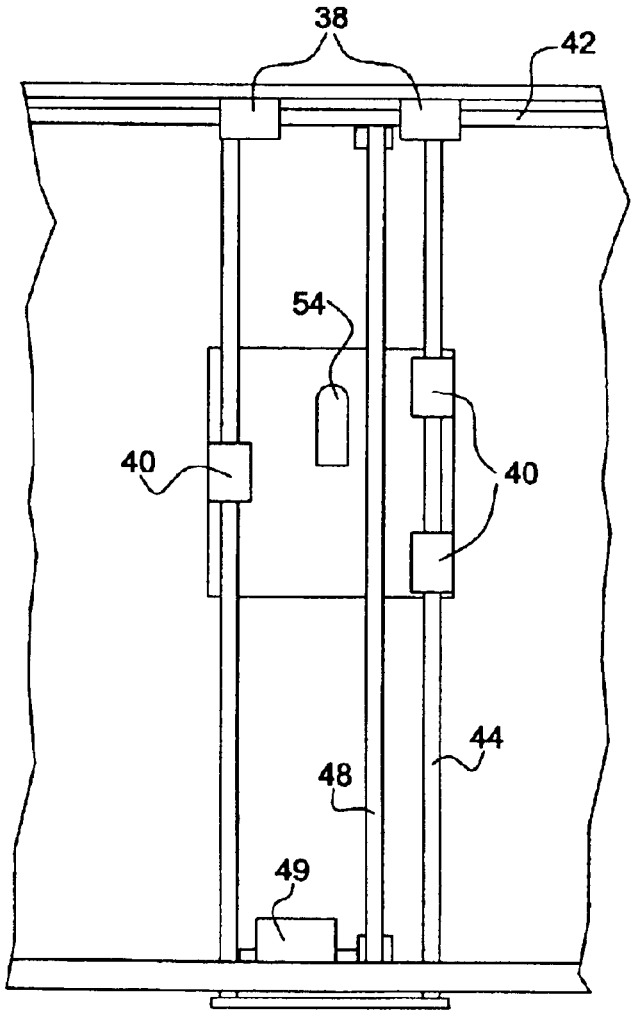
FIG. 10 is a top view of the delivery mechanism of the vending machine of FIG. 9.
Figure 9:
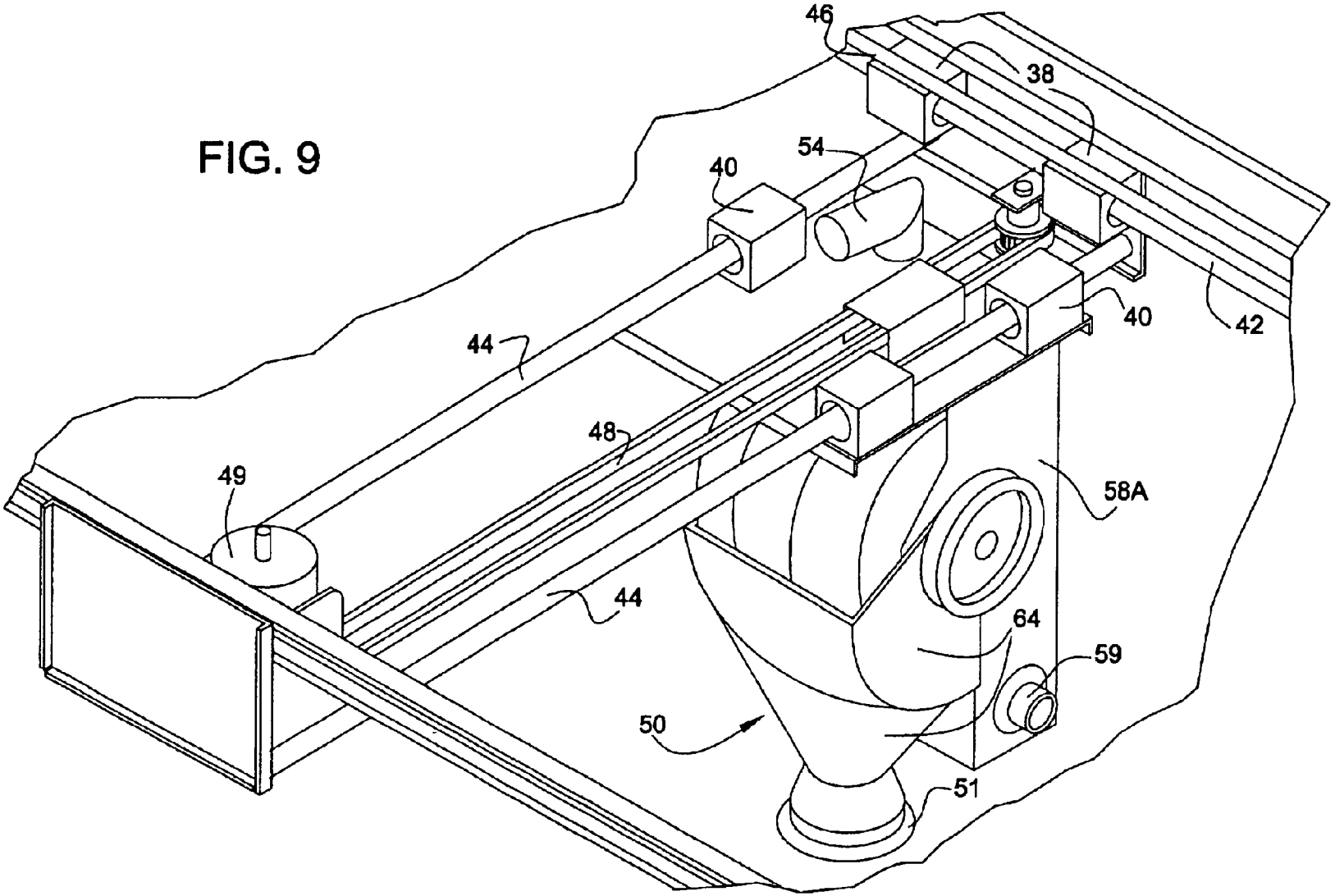
FIG. 9 is a perspective view of the delivery mechanism of the vending machine of FIG. 1, with the pick-up mechanism in the vertical position.
Figure 11:
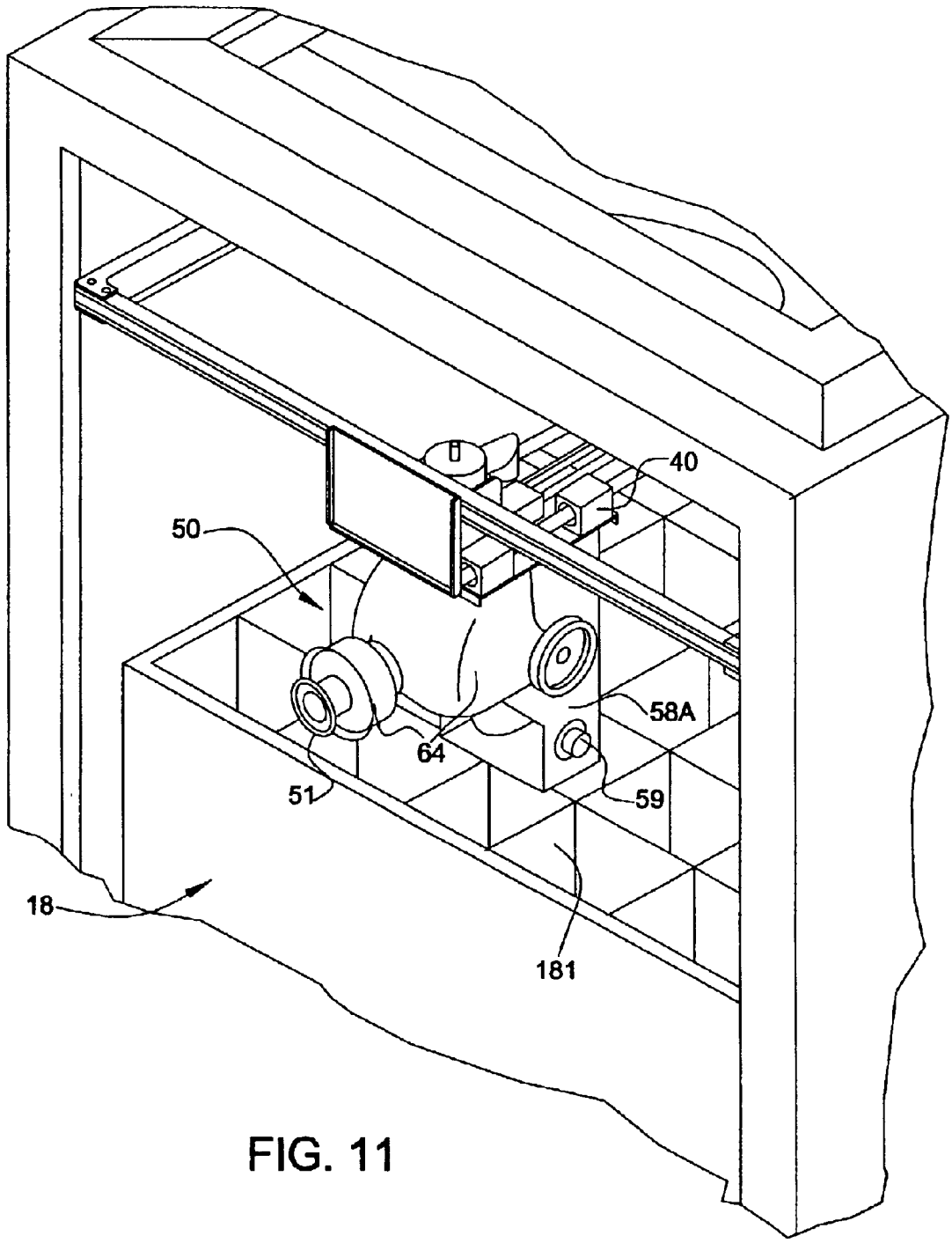
FIG. 11 is a perspective view of the delivery mechanism of the vending machine of FIG. 1, with the pick-up mechanism in the tip-up, product delivery position.

As shown in FIGS. 9, 10 and 11, the X-Y motion is provided by a common linear bearing and bar-based cross-slide mechanism. Carriages 38, 40 for the X and Y axes, respectively, glide on recirculating ball bearings fitted on precision-ground shafting. Alternatively, fluorocarbon-based bearings may be used. The shafting includes X-axis bars 42 and Y-axis bars 44. The X-axis bars 42 extend between the left and right sides, 22*c*, 22*d*, respectively, of the container, while the Y-axis bars span the distance between the front and rear sides, 22*a*, 22*b*, respectively, of the container. Axial motion of the carriages is provided by toothed belts and pulleys 46, 48 driven by stepper motors 49. Provision of X-Y motion by such devices is well known in the art, representatively depicted in U.S. Pat. Nos. 5,240,139 and 5,322,187, although any known device for this purpose may be used. According to a preferred embodiment of the present invention, linear bearings and shafting manufactured by Thomson Industries may be suitably employed.

The vacuum system 36 includes the pick-up mechanism, generally designated by the reference numeral 50 and having a vacuum suction head 51, a vacuum pump or blower 53 (shown in FIG. 17) to provide negative pressure for lifting packages, extension hose 52 to route the negative pressure from the pump 53 to the pick-up mechanism 50, a manifold 54 to allow interface to the Z motion axis, and conventional pressure sensing circuitry (not shown), such as a diaphragm switch, to control power to the pump. The pick-up mechanism is shown in the resting position in FIG. 9 and in the delivery position in FIG. 11. The extension hose 52 is not shown in FIGS. 9, 10 and 11.

Figure 13:
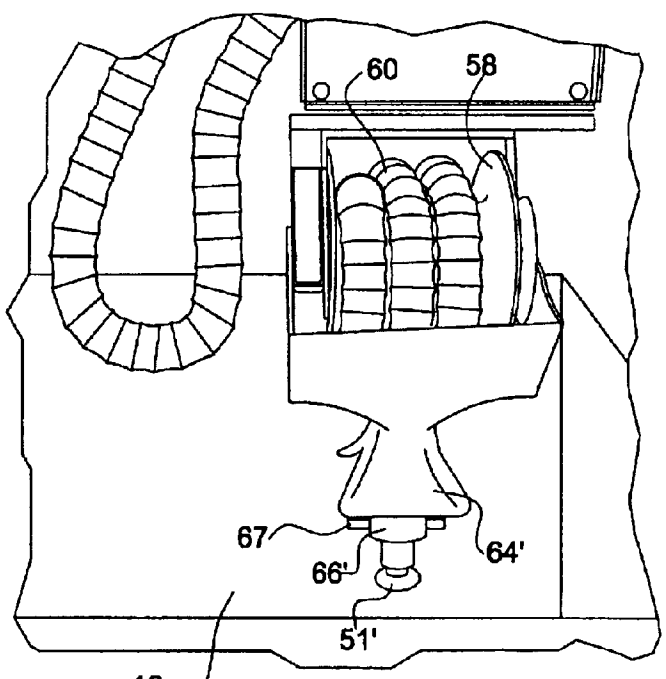
FIG. 13 is a front view of the pick-up mechanism with vacuum hose, hose reel and an alternative funnel guide design in accordance with the present invention.
Figure 14:
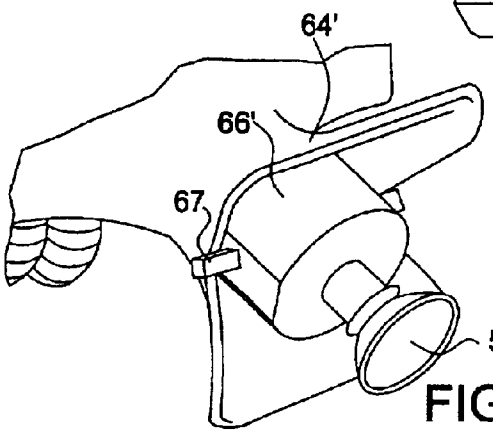
FIG. 14 is a perspective view of the vacuum suction head of the alternative design pick-up mechanism of FIG. 13.
Figure 12:
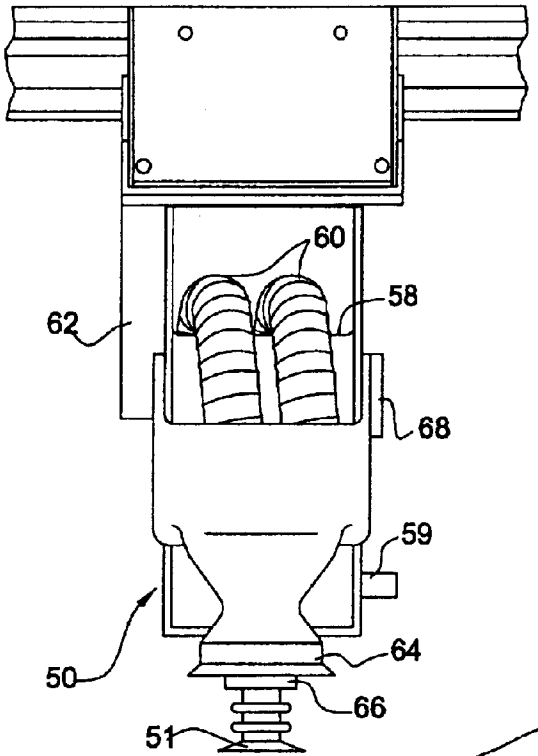
FIG. 12 is a front view of the delivery mechanism of FIG. 9.

Operation and retraction of the pick-up mechanism 50 with the Z-axis member drive is effected with minimal vertical space requirements through the use of a hose reel, drive mechanism and guide elements, illustrated in FIGS. 12, 13 and 14.

FIG. 12 is a front view of the pick-up mechanism 50 according to one embodiment of the present invention. The hose reel 58, mounted within a hose reel frame 58A, is conceptually similar to a typical garden hose reel in that it is hollow, is supported by bearings, and one of the bearings includes a sealed port for moving air out of the hollow center. The reel 58 is designed for a single layer wind, i.e., spiral wind for the vacuum hose 60. Preferably an elbow fitting 62 is included to feed negative pressure to the vacuum hose 60.

A Z-axis drive motor with gear reducer and flexible end drive, mounted behind pulley 59, is used to rotate the reel 58 in both unwind and wind-up directions. This Z-axis drive motor has the ability to stall at the end of the wind-up phase and maintain a holding torque on the reel until the product vend is complete. Such holding torque capability also provides the operating means for the "tip-up" function which represents a fourth rotational degree of freedom, W. The vacuum hose 60 has sufficient tensile strength to act as the force member for the tip-up function and enough linear rigidity to permit a push during the unwind part of the cycle.

A funnel-shaped guide member 64 is used to align the vacuum hose 60 during the unwind (descent) and wind-up (return) phases of the hose motion. This funnel guide member 64 is attached to the hose reel frame 58A, preferably by means of a shaft 68 or pin which permits rotation of the funnel 64 through an angle of 90 degrees. The force to rotate the funnel to a horizontal position is provided by tension on the vacuum hose 60 during the overdrive portion of the rewind phase. The funnel 64 is retracted to normal position by a tension spring 71, shown in FIGS. 15 and 16, that operates in conjunction with the delivery port opening structure 19.

Figure 6:
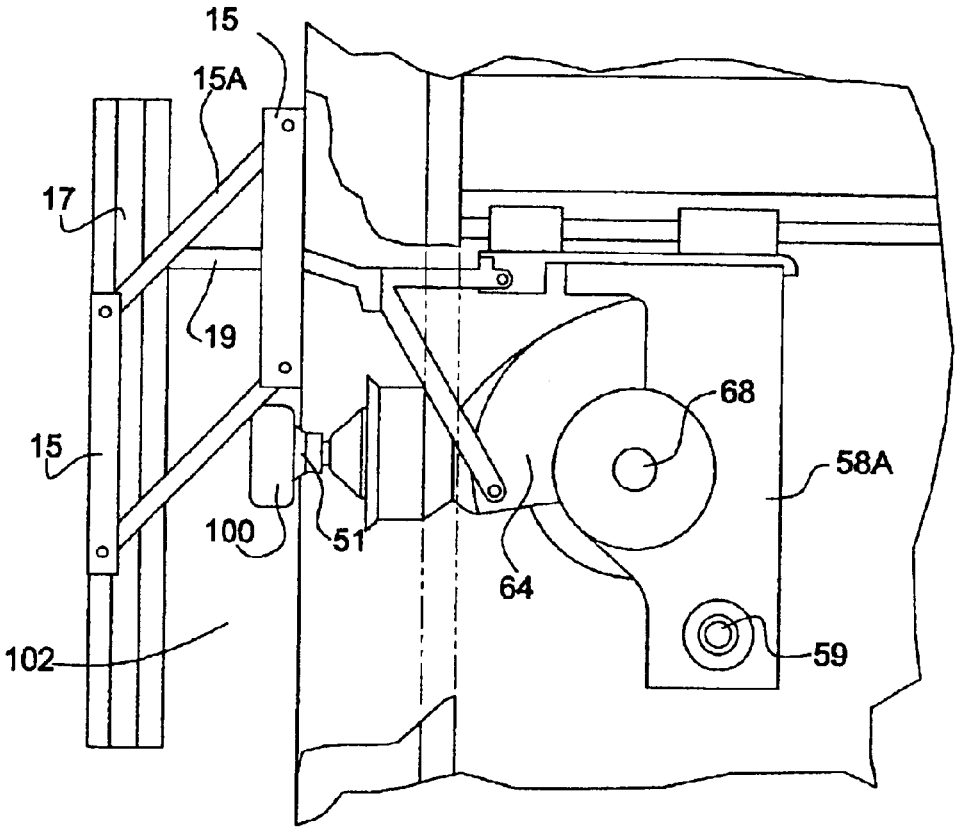
FIG. 6 is a side view of the product delivery mechanism in the horizontal position with open hatch mechanism, in accordance with the present invention.
Figure 7:
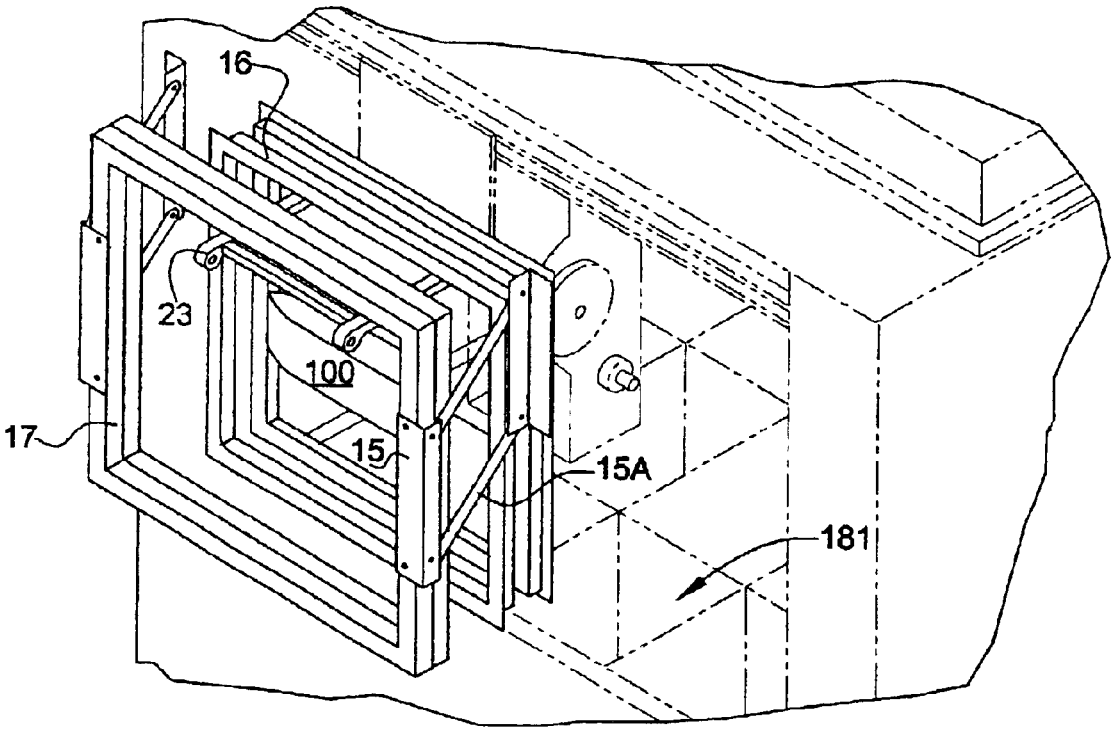
FIG. 7 is a perspective view of the hatch mechanism of FIG. 6.
Figure 15:
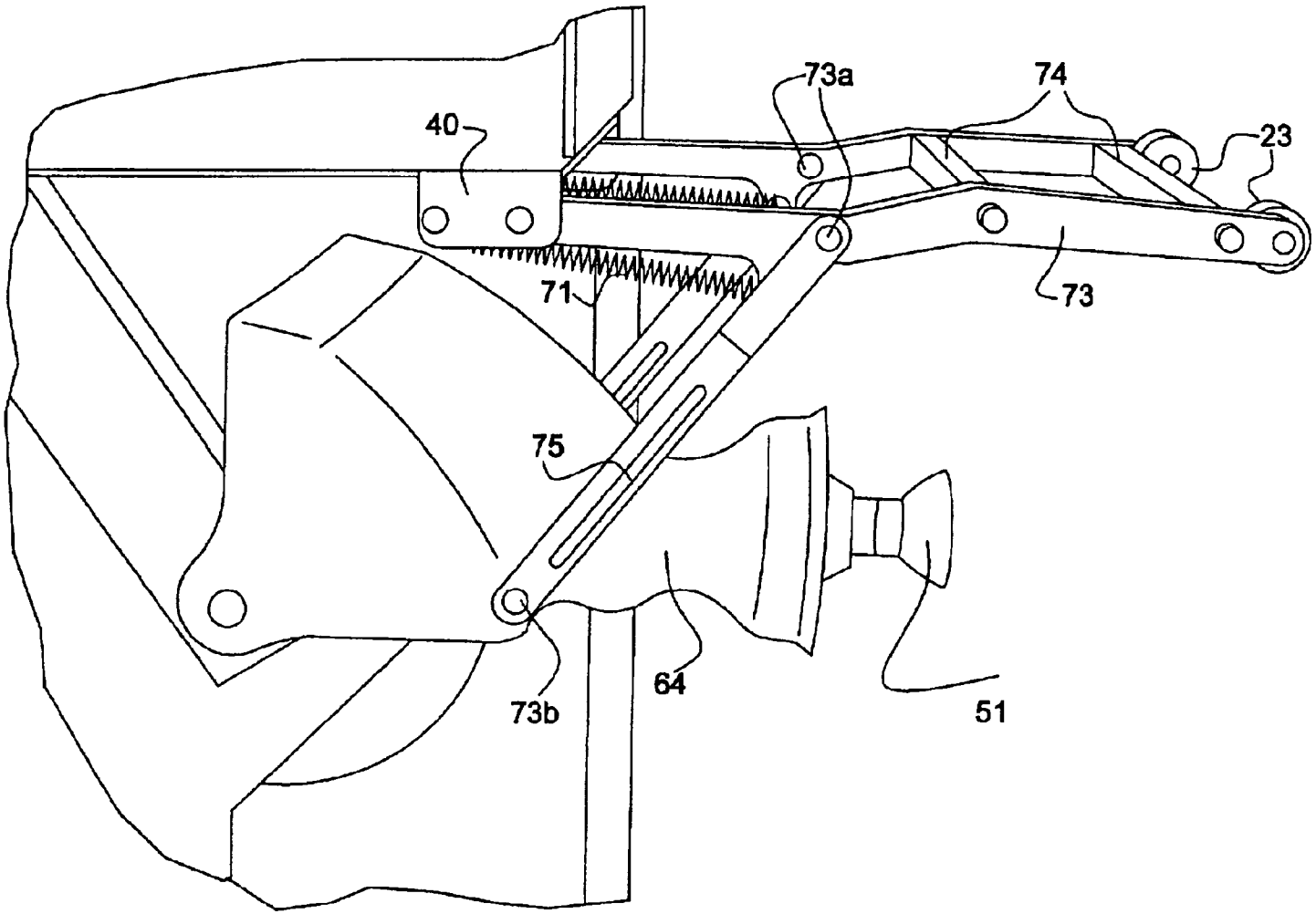
FIG. 15 is a side view of the funnel guide of FIG. 13 shown in the horizontal position with the extension bar of the delivery port opening structure deployed in the horizontal position.
Figure 16:
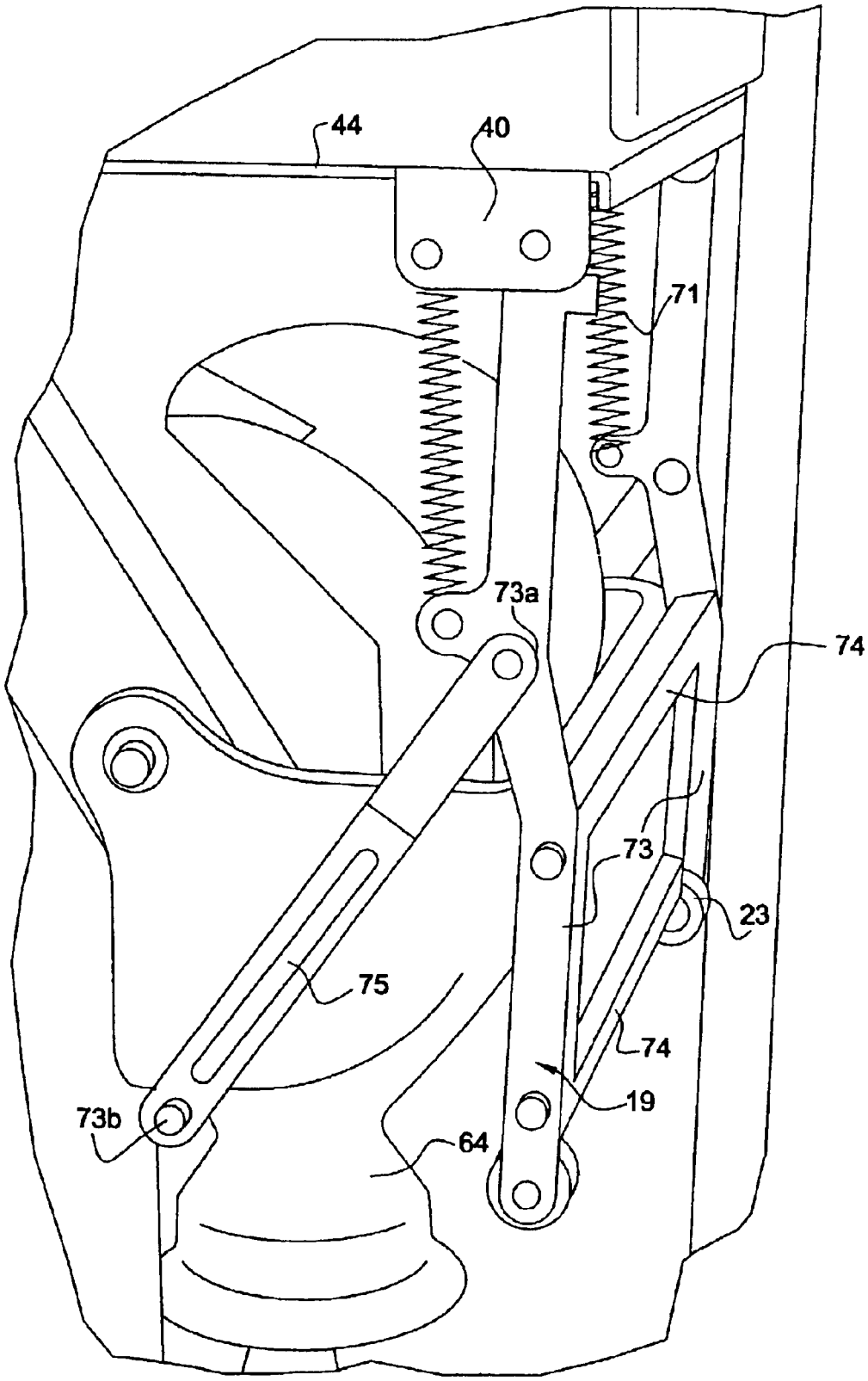
FIG. 16 is a side view of the funnel guide and delivery port opening structure of FIG. 15, shown in the vertical position.

FIG. 15 depicts the funnel 64 in the horizontal position with the delivery port opening structure 19 also extended in the horizontal position to contact the hatch 17, as shown in FIGS. 6 and 7. As depicted in FIG. 15, the delivery port opening structure includes two extension bars 73 joined by connecting elements 74. The extension bars 73 are hingedly connected to the carriage 40 that travels along the Y-axis bar 44 (FIG. 16). Each extension bar 73 is hingedly connected at a midpoint 73*a* to an arm 75 which is hingedly connected at point 73*b* to the funnel 64. As the tip-up motion is applied to the funnel 64, this motion is also applied to the arms 75 and therethrough to the extension bars 73 to deploy the delivery port opening structure 19 into the horizontal position for contacting and opening the hatch. Following product delivery, the funnel returns to the vertical position through cessation of the overdrive portion of the rewind phase and tension exerted thereon by the spring 71; concurrently, the delivery port opening structure 19 is also lowered into the vertical storage position, as shown in FIG. 16.

As an additional hose guide mechanism, a weight 66 is attached to the pick-up end of the vacuum hose 60. This weight 66 serves to straighten the vacuum hose during the unwind phase and acts as a stop, through contact with the funnel 64, upon completion of the rewind phase.

FIGS. 13 and 14 show an alternative embodiment of the funnel guide member 64 with the vacuum hose 60 on the reel structure 58 and positioned over the container 18 forming the virtual cold-wall freezer unit. As shown, the weight 66 includes one or more outwardly extending projections 67 which provide a centering force along the narrow part of the product bin as the hose enters and feeds to the product level. If increased hose stability is needed in the rewind direction, a chain/cable track with plastic links may be installed to follow the motion of the hose and provide stability along the unguided Z axis. Representatively, such a chain/cable track is manufactured by Igus, Inc.

The suction head 51 may be made from any material which is sufficiently soft and pliable so as to conform to the surface of the products and form a seal thereon for pick up. Accordingly, any shape that allows this function may be employed. The shape of the funnel guide member 64 may also vary, having pronounced flares such as those shown in FIG. 14 or being essentially conical, although some flaring has been found to be desirable for easier centering of the weight 66 as it is raised to its resting location against the funnel guide member.

Figure 17:
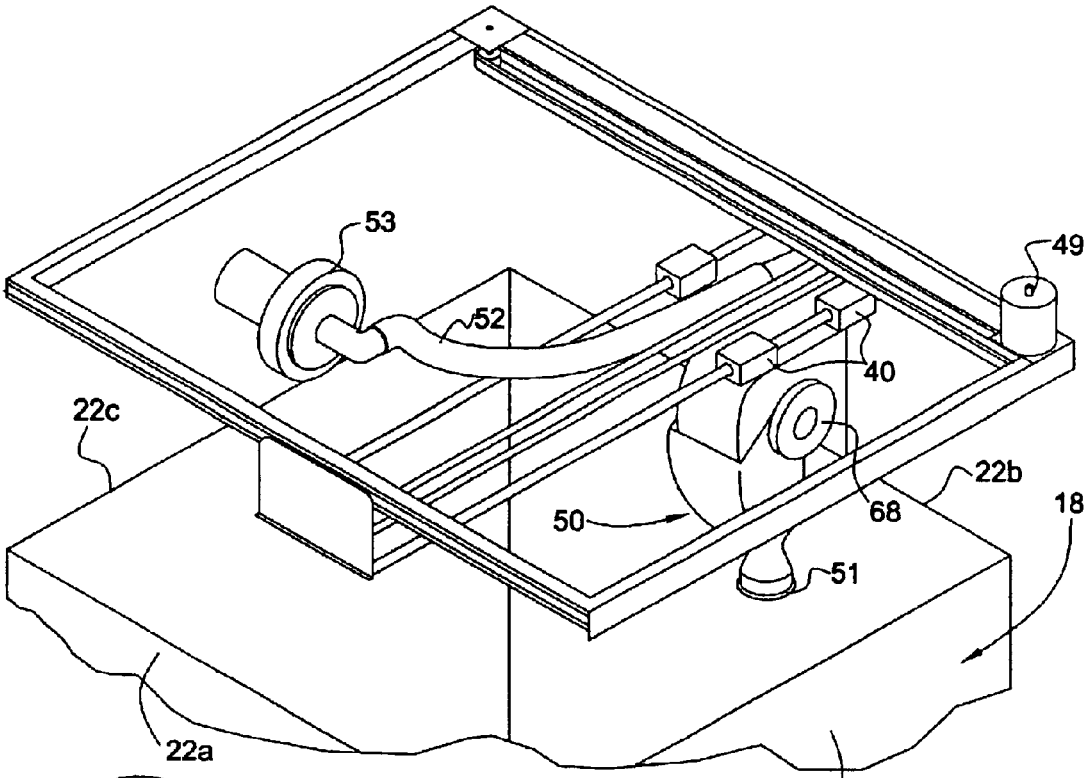
FIG. 17 is a perspective view of the delivery mechanism of the vending machine of FIG. 1, with the pick-up mechanism in the at-rest position.
Figure 18A:
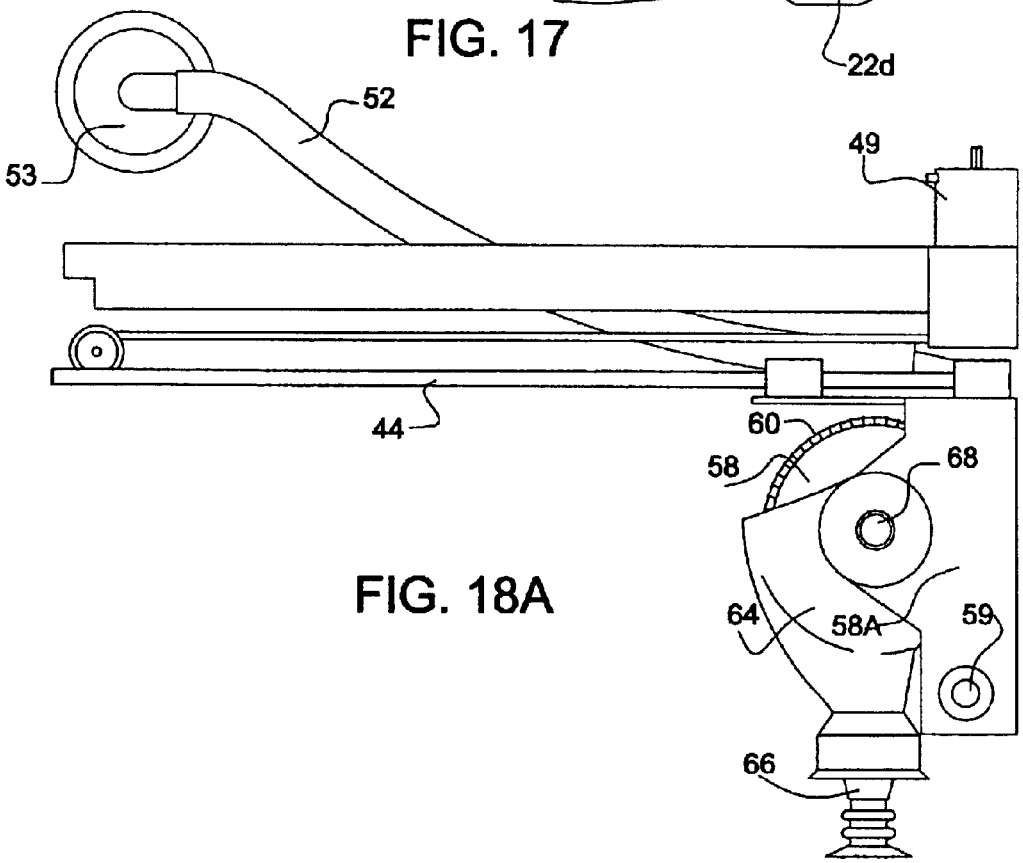
FIG. 18A is a side view of the delivery mechanism of the vending machine of FIG. 17 with the vacuum hose in the wound up position.
Figure 18B:
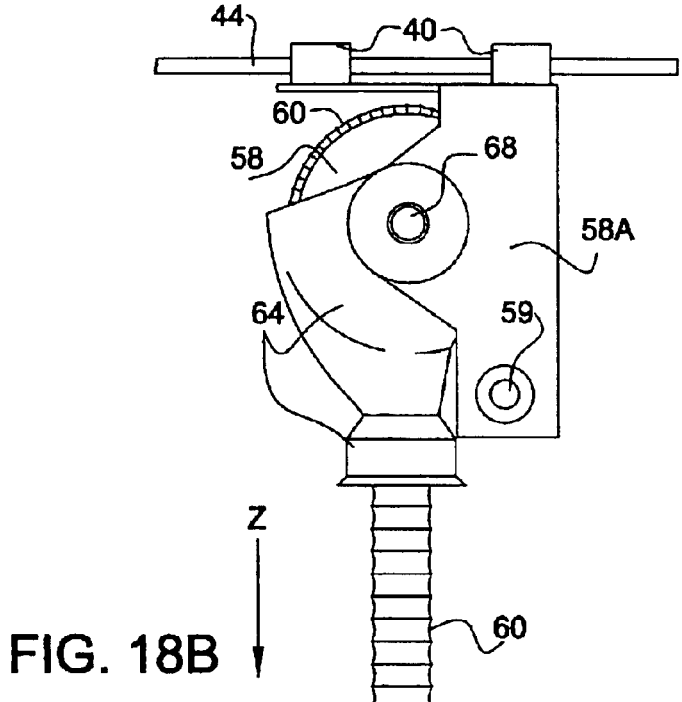
FIG. 18B is a side view of the delivery mechanism of the vending machine of FIG. 1 with the vacuum hose in an unwound condition.

FIG. 17 is a perspective view of the product delivery mechanism 20 of the present invention showing the extension hose 52 with the pick-up mechanism 50 fully retracted along the Y axis. When the pick and place mechanism is in the "at rest" position, shown in FIGS. 17 and 18A, the hose 60 is wound on the reel 58 with the funnel 64 in a vertical position and the vacuum blower off. To retrieve a product, the controller 30 directs the pick-up mechanism to move to the appropriate grid coordinates along the X and Y axes at which point the controller turns on the vacuum blower and the Z-axis drive motor begins the unwind operation, lowering the pick-up head 51 along the Z axis. As shown in FIG. 18B, when contact with a package 100 is sensed, detected by pressure sensing circuitry (not shown) as a significant change in hose pressure, the Z motion is paused. The pressure sensing circuitry may be located anywhere within the hose 52, but is preferably positioned close to the intake, for the vacuum pump 53. The pressure sensor may be embodied as any device, such as a switch or a transducer, that causes a signal to be produced in response to a change in differential pressure.

Following a short dwell period, and confirmation that a steady-state blank-off pressure has been achieved, the Z-axis drive motor reverses, returning the pick-up head 51 to its Z home position with the package held by suction thereto. If full blank-off is not achieved, the controller will attempt to reseat the vacuum head by a short lifting and lowering stroke of the pick-up head.

Figure 18C:
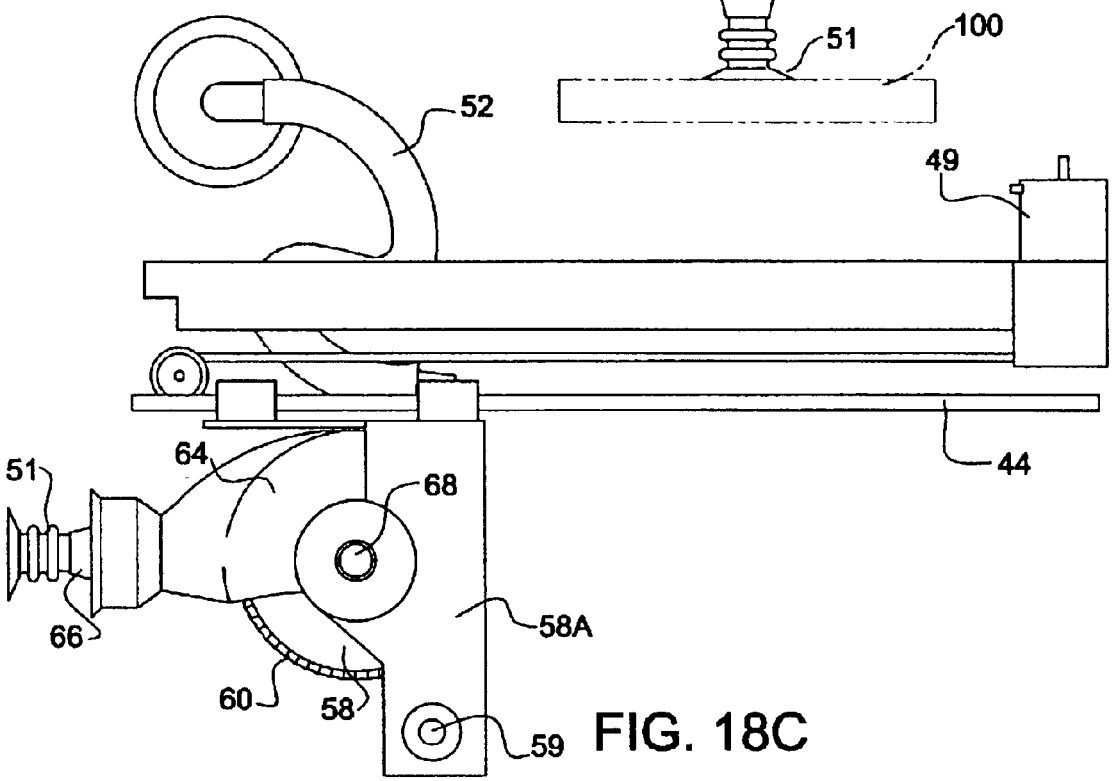
FIG. 18C is a side view of the delivery mechanism of the vending machine of FIG. 1, with the pick-up mechanism in the tip-up and product delivery position.

As the hose 60 is fully retracted, the hose guide weight 66 makes contact with the funnel 64. The controller 30 "over drives" the Z-axis drive motor and the resulting force rotates the funnel 90° to a horizontal orientation. The pick-up head is then moved along the X and Y axes, as necessary, to reach the product delivery port 16, the funnel remaining in the horizontal orientation. The product delivery port 16 is, located on the same horizontal plane as the pick-up head when the pick-up mechanism is in the fully rewound Z-axis position. As shown in FIG. 18C, the extension hose 52 coils to accommodate the full range of motion from rest to product delivery.

Figure 19:
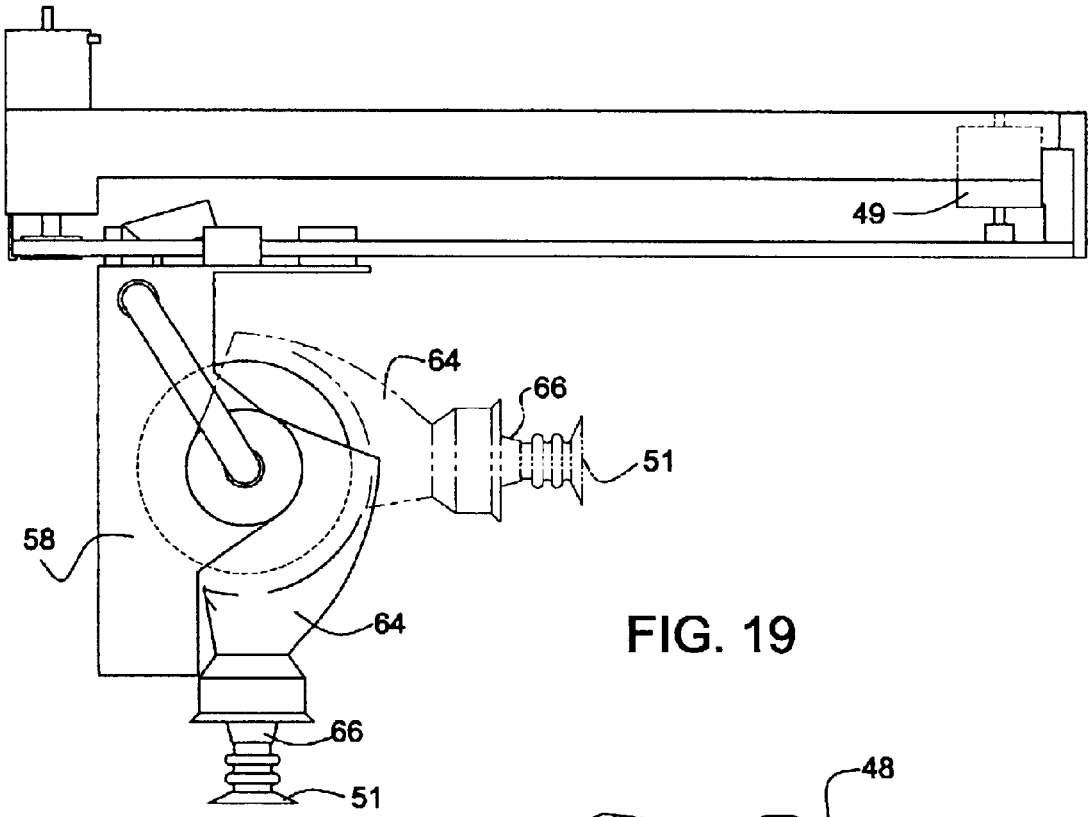
FIG. 19 is a side view of the delivery mechanism of the vending machine according to the present invention, showing the range of motion of the pick-up mechanism.
Figure 20:
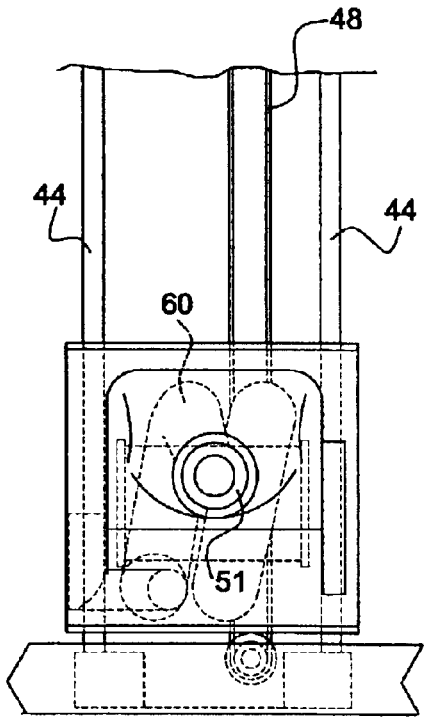
FIG. 20 is a bottom view of the delivery mechanism in accordance with the present invention.

When the pick-up head nears the delivery port, the Y motor drives the delivery port opening structure 19 connected to the funnel to open the hatch 17 and then steps the product 100 through the port 16. Upon reaching the delivery position, the Y motor 49 momentarily pauses. Simultaneously, the controller shuts down the vacuum blower 53 and, when pressure returns to atmospheric (and a variable dwell-count is achieved) the product 100 is released onto a gently inclined delivery chute 13 down which the product slides to an access door 116 in the outer door 14B for delivery to the customer. The pick-up head with delivery port opening structure 19 then retracts back into the freezer, allowing the hatch 17 to close, and returns to a home X-Y axis position. The Z-axis drive motor unwinds slightly to release tension from the hose 60, and the tension spring 71 acts to return the funnel 64 and delivery port opening structure to the vertical position, as shown in FIG. 18A. The pick and place mechanism is then again in the "at rest" state. FIG. 19 illustrates the range of movement of the pick-up mechanism 50. A bottom view of the delivery mechanism in the at rest state is provided in FIG. 20.

Delivery of the product is preferably confirmed with an electric eye type sensor. The sensor is preferably located in the outer door 14B and, after the product has dropped from the chute 13 to the delivery area, verifies that an item was actually provided. If delivery is not confirmed, the entire cycle will be attempted again. If the second attempt fails, then the selection will acquire a "sold-out" status and a message is presented on the display 32 suggesting another selection.

For all X-Y positioning, the stepper motors 49 can be operated serially or in parallel. For the sake of speed, parallel operation is desirable, but simplicity is enhanced with serial operation.

As already noted, unlike the prior art, the present invention does not drop the selected product for delivery to the customer near the bottom of the vending machine. Instead, the W motion or "tip-up" movement rotates the product out of the horizontal plane and into a vertical plane. The tip-up movement not only permits the product to be released high in the machine, but also changes the orientation of the product to minimize required delivery chute depth 102 as it is only necessary to accommodate product thickness. Therefore, unlike the prior art in which products are dispensed in a horizontal plane, the chute depth need only be just greater than a maximum thickness of the frozen products to be dispensed from the vending machine; this depth may be less than a width of the products. The rotation also maximizes freezer compartment product storage volume while preserving the integrity of the often fragile frozen product. Finally, the high delivery port 16 with reduced depth minimizes cold air spill and warm air ingress into the freezer compartment 12.

The foregoing descriptions and drawings should be considered as illustrative only of the principles of the invention. The invention may be configured in a variety of shapes and sizes and is not limited by the dimensions of the preferred embodiment. Numerous applications of the present invention will readily occur to those skilled in the art. Therefore, it is not desired to limit the invention to the specific examples disclosed or the exact construction and operation shown and described. Rather, all suitable modifications and equivalents may be resorted to, falling within the scope of the invention.

What is claimed is:

1. A frozen product vending machine for selectively delivering one of a plurality of frozen products to a customer comprising:

an upright style freezer unit having a cooled interior for storing the plurality of frozen products;

a product delivery mechanism for selectively removing a frozen product in response to customer selection, said product delivery mechanism having a linear bearing and cross-slide mechanism mounted within said freezer unit for movement in X and Y directions and, for movement along a Z axis direction, said product delivery mechanism including;

a hose reel;

a length of vacuum hose wound upon said hose reel, said length of hose having an inflow end and an outflow end;

a pick-up head coupled to said inflow end of said length of vacuum hose;

a vacuum pump mounted in said freezer unit for generating negative pressure;

an extension hose coupling an output of said vacuum pump to said outflow end of said length of vacuum hose for directing negative pressure from said pump to said pick-up head to pick up a frozen product from said container by suction;

a Z-axis drive motor for driving rotation of said hose reel to unwind and wind said length of vacuum hose for extending and retracting said length of hose along the Z axis direction; and a guide member rotatably connected to said hose reel for aligning said vacuum hose when winding and unwinding, and said guide member being rotatable through approximately 90° from a vertical position to a horizontal position in response to tension exerted on said vacuum hose by said Z-axis drive motor when said vacuum hose is fully wound up on said reel.

2. The frozen product vending machine as set forth in claim 1, wherein said product delivery mechanism is located inside said freezer unit and said pick-up head is positioned over a selected product before said Z-axis drive motor is activated to unwind said vacuum hose for product pick-up.

3. The frozen product vending machine as set forth in claim 1, said product delivery mechanism further including a weight attached to said pick-up head for straightening said vacuum hose during an unwinding phase and for providing a stop through contact with said guide member upon completion of a rewind phase.

4. The frozen product vending machine as set forth in claim 1, said product delivery mechanism further comprising a delivery port opening structure, hingedly connected to said guide member and rotatable with said guide member from said vertical position to said horizontal position, said delivery port opening structure including an extension bar for pushing open a hatch covering said delivery port, and a spring for assisting return of said guide member to said vertical position following product delivery.

5. A frozen product vending machine for selectively delivering one of a plurality of frozen products to a customer comprising:

an upright style freezer unit having a cooled interior for storing the plurality of frozen products;

a product delivery mechanism for selectively removing a frozen product in response to customer selection, said product delivery mechanism having a linear bearing and cross-slide mechanism mounted within said freezer unit for movement in X and Y directions and, for movement along a Z axis direction, said product delivery mechanism including, a hose reel;

a length of vacuum hose wound upon said hose reel, said length of hose having an end coupled to a vacuum source and a inflow end;

a pick-up head coupled to said inflow end of said length of vacuum hose for picking up a selected frozen product by suction; and a Z-axis drive motor for driving rotation of said hose reel to unwind and wind said length of vacuum hose for extending and retracting said length of hose along the Z axis direction.

6. The frozen product vending machine as set forth in claim 5, further comprising a delivery port in a front portion of said freezer unit, said delivery port on a horizontal plane common with said product delivery mechanism when positioned for product delivery.

7. The frozen product vending machine as set forth in claim 6, wherein a delivery chute is positioned below said delivery port, a depth of said chute corresponding to just greater than a maximum thickness of the frozen products being delivered.

8. The frozen product vending machine as set forth in claim 5, said product delivery mechanism further including:

a guide member rotatably connected to said hose reel for aligning said vacuum hose when winding and unwinding, said guide member rotatable through approximately 90° from a vertical position to a horizontal position in response to tension exerted on said vacuum hose by said Z-axis drive motor when said vacuum hose is fully wound up on said reel.

9. The frozen product vending machine as set forth in claim 8, said product delivery mechanism further including a weight attached to said pick-up head for straightening said vacuum hose during an unwinding phase and for providing a stop through contact with said guide member upon completion of a rewind phase.

10. The frozen product vending machine as set forth in claim 8, further comprising a delivery port closed with a hingedly connected hatch in a front portion of said freezer unit for allowing the selected frozen product to be delivered to the customer therethrough when said guide member is in said horizontal position.

11. The frozen product vending machine as set forth in claim 10, said product delivery mechanism further comprising a delivery port opening structure, hingedly connected to said guide member and rotatable with said guide member from said vertical position to said horizontal position, said delivery port opening structure including an extension bar for pushing open said hatch covering said delivery port, and a spring for assisting return of said guide member to said vertical position following product delivery.

12. The frozen product vending machine as set forth in claim 5, further comprising a container situated within a bottom portion of said freezer unit for storing the plurality of frozen products, said container being open at a top thereof, said product delivery mechanism selectively removing a frozen product from said container through said open top.

13. The frozen product vending machine as set forth in claim 12, wherein said container has four sides and a bottom and is constructed of a thermally conductive material.

14. The frozen product vending machine as set forth in claim 13, wherein said bottom is spaced from an inner bottom surface of said freezer unit and each of said four sides is spaced at a distance from a corresponding inner wall surface of said freezer unit.

15. A frozen product vending machine for selectively delivering one of a plurality of frozen products to a customer comprising:

an upright style freezer unit having a cooled interior for storing the plurality of frozen products;

a product delivery mechanism for selectively removing a frozen product in response to customer selection, said frozen products located beneath said product delivery mechanism which is moveable in X, Y and Z axis directions and includes a pick-up head with a tip-up mechanism for rotational movement of said pick-up head from a vertical position for product pick-up through approximately 90° to a horizontal position; and a delivery port in a front portion of said freezer unit, said delivery port located on a horizontal plane allowing the selected frozen product to be delivered to the customer therethrough when said pick-up head is in said horizontal position.

16. The frozen product vending machine as set forth in claim 15, wherein a delivery chute is positioned below said delivery port, a depth of said chute corresponding to just greater than a maximum thickness of the frozen products being delivered.

17. The frozen product vending machine as set forth in claim 15, said product delivery mechanism further including:

a hose reel;

a length of vacuum hose wound upon said hose reel, said length of hose having an end coupled to a vacuum source and an inflow end coupled to said pick-up head; and a Z-axis drive motor for driving rotation of said hose reel to unwind and wind said length of vacuum hose for extending and retracting said length of hose along the Z axis direction.

18. The frozen product vending machine as set forth in claim 17, said product delivery mechanism further including:

a guide member rotatably connected to said hose reel for aligning said vacuum hose when winding and unwinding, said guide member for rotating said pick-up head from said vertical position to said horizontal position in response to tension exerted on said vacuum hose by said Z-axis drive motor when said vacuum hose is fully wound up on said reel.

19. The frozen product vending machine as set forth in claim 18, said product delivery mechanism further including a weight attached to said pick-up head for straightening said vacuum hose during an unwinding phase and for providing a stop through contact with said guide member upon completion of a rewind phase.

20. The frozen product vending machine as set forth in claim 18, said product delivery mechanism further comprising a delivery port opening structure, hingedly connected to said guide member and rotatable with said guide member from said vertical position to said horizontal position, said delivery port opening structure including an extension bar for pushing open a hatch covering said delivery port, and a spring for assisting return of said guide member to said vertical position following product delivery.

21. The frozen product vending machine as set forth in claim 15, further comprising a container within said cooled interior of said freezer unit for storing the plurality of frozen products, said container being open at a top thereof, said product delivery mechanism selectively removing a frozen product from said container through said open top.

22. The frozen product vending machine as set forth in claim 21, wherein said container has four sides and a bottom and is constructed of a thermally conductive material.

23. The frozen product vending machine as set forth in claim 22, wherein each of said four sides is spaced at a distance from a corresponding inner wall surface of said freezer unit.

24. An automated method of picking up a product within a vending machine having X, Y and Z drive members for moving a vacuum pick-up head located within the vending machine in X, Y and Z axis directions, respectively, said pick-up head attached to a vacuum hose which is wound and unwound on a reel, said method comprising the steps of:

moving said pick-up head in a wound-up vertical position in at least one of an X axis direction and a Y axis direction using associated drive members, in response to a product selection, until said pick-up head is located above said selected product;

activating the vacuum pick-up head to create suction;

initiating said Z drive member to unwind said vacuum hose and lower said pick-up head in a Z axis direction to contact the selected product;

securing the selected product against the pick-up head with said suction;

winding up said vacuum hose to return said pick-up head to said wound-up vertical position;

over-driving said Z axis drive member to create tension on said vacuum hose, said tension rotating said pick-up head by approximately 90° to a wound-up horizontal position;

moving said pick-up head in said wound-up horizontal position in at least one of said X axis direction and said Y axis direction using associated drive members, until said pick-up head is located adjacent a delivery port;

delivering the selected product to a customer through said delivery port.

25. The method as set forth in claim 24, further comprising releasing said over-drive tension on said vacuum hose to allow said pick-up head to return to said wound-up vertical position.

* * * * *